US012275560B2

(12) United States Patent
Ootaka et al.

(10) Patent No.: US 12,275,560 B2
(45) Date of Patent: Apr. 15, 2025

(54) PACKAGING STRUCTURE

(71) Applicant: MABUCHI MOTOR CO., LTD., Chiba (JP)

(72) Inventors: Ryou Ootaka, Chiba (JP); Taiyo Miyazaki, Chiba (JP); Masayuki Iida, Chiba (JP); Hayanori Kadoguchi, Chiba (JP)

(73) Assignee: MABUCHI MOTOR CO., LTD., Chiba (JP)

( * ) Notice: Subject to any disclaimer, the term of this patent is extended or adjusted under 35 U.S.C. 154(b) by 0 days.

(21) Appl. No.: 18/574,288

(22) PCT Filed: Apr. 25, 2023

(86) PCT No.: PCT/JP2023/016367
§ 371 (c)(1),
(2) Date: Dec. 26, 2023

(87) PCT Pub. No.: WO2024/224494
PCT Pub. Date: Oct. 31, 2024

(65) Prior Publication Data

US 2024/0359870 A1 Oct. 31, 2024

(51) Int. Cl.
*B65D 25/10* (2006.01)
*B65D 85/68* (2006.01)

(52) U.S. Cl.
CPC ..... *B65D 25/108* (2013.01); *B65D 85/68* (2013.01); *B65D 2585/6877* (2013.01)

(58) Field of Classification Search
CPC ..... B65D 25/108; B65D 25/10; B65D 85/68; B65D 81/133; B65D 81/127;
(Continued)

(56) References Cited

U.S. PATENT DOCUMENTS 3,682,597 A * 8/1972 Husch ..... G01N 33/03 436/60
4,185,766 A * 1/1980 Davidson ..... B65D 5/5061 206/422

(Continued)

FOREIGN PATENT DOCUMENTS

CN 204137611 U 2/2015
CN 205256837 U 5/2016

(Continued)

OTHER PUBLICATIONS

Microfilm of the specification and drawings annexed to the request of Japanese Utility Model Application No. 52-134555 (Laid-open No. 54-61871) (Nakatsugawa Package Industries) Apr. 28, 1979 (Apr. 28, 1979) (Family: none).

(Continued)

*Primary Examiner* — Steven A. Reynolds
(74) *Attorney, Agent, or Firm* — HAUPTMAN HAM, LLP

(57) ABSTRACT

A packaging structure of the disclosure includes: a box in which a component is stored; and a holding member installed in the box, the holding member being configured to hold the component. The holding member includes: an undersurface portion that has a first opening portion into which the component is inserted and is placed on a bottom surface of the box; a top surface portion that has a second opening portion into which the component is inserted and is placed above the undersurface portion; and a first side surface portion connecting the undersurface portion and the top surface portion in an up-and-down direction. The holding member is formed by being bent along boundary lines between the first side surface portion, the undersurface portion, and the top surface portion, and is formed into two kinds of three-dimensional shapes that are mirror symmetric
(Continued)

to each other, according to bending directions of the boundary line.

8 Claims, 8 Drawing Sheets

(58) Field of Classification Search
CPC .... B65D 81/025; B65D 81/05; B65D 5/5038; B65D 2585/6877; B65D 2585/6882
USPC ..... 206/443, 486, 779, 490
See application file for complete search history.

(56) References Cited

U.S. PATENT DOCUMENTS 5,335,846 A * 8/1994 Smith ..... B65D 77/02 229/120.32
5,358,116 A * 10/1994 Brintazzoli ..... B65D 5/5061 206/443
5,720,390 A * 2/1998 Bostelman ..... B65D 5/5038 206/589
5,725,109 A * 3/1998 Moulton ..... B01L 9/06 211/73
6,935,505 B1 * 8/2005 Nash, Jr. ..... B65D 71/72 206/486
2020/0354102 A1 * 11/2020 Hsieh ..... B65D 5/5038
2021/0179316 A1 * 6/2021 Christino ..... B65D 5/5038
2022/0089312 A1 * 3/2022 Meuti ..... B65D 5/5038

FOREIGN PATENT DOCUMENTS

DE 9400523 U1 2/1994
JP S54-061871 U 4/1979
JP H05-270566 A 10/1993
JP 2913259 B2 6/1999
JP 2000-109166 A 4/2000
JP 2015-187007 A 10/2015

OTHER PUBLICATIONS

International Search Report in PCT/JP2023/016367, mailed Jun. 20, 2023, 2pp.
Written Opinion in PCT/JP2023/01367, mailed Jun. 20, 2023, 9pp.
Office Action in CN Application No. 202380012534.3 dated Aug. 6, 2024, 9pp.
Office Action in CN Application No. 202380012534.3 dated Sep. 19, 2024, 10pp.
Office Action in DE Application No. 112023000132.4 dated Oct. 1, 2024, 8pp.
Office Action in CN Application No. 202380012534.3, dated Apr. 1, 2024, 12pp.

* cited by examiner

STORED STATE OF MOTOR (L-SHAPED)

CROSS-SECTIONAL VIEW ALONG A—A

CROSS-SECTIONAL VIEW ALONG B—B

PACKAGING STRUCTURE

RELATED APPLICATIONS

The present application is a National Phase of International Application Number PCT/JP2023/016367, filed Apr. 25, 2023.

TECHNICAL FIELD

The present invention relates to a packaging structure for components.

BACKGROUND ART

Packing boxes for storing components manufactured in plants and factories are conventionally used to transport the components to, for example, warehouses and outside the sites. A protective structure for protecting the components from vibrations and impact that are caused during transportation while holding the components stably is provided in a general packing box. A vertical divider structure in which a plurality of corrugated cardboard sheets is assembled in a matrix form, and an insert tray structure formed by having, on a dish-shaped tray, opening portions in which components are placed are known as specific examples of the protective structure (refer to, for example, Patent Literatures 1 and 2).

CITATION LIST

Patent Literature

Patent Literature 1: Japanese Patent No. 2913259
Patent Literature 2: CN-U-205256837

DISCLOSURE OF THE INVENTION

Problems to be Solved by the Invention

In the vertical divider structure according to the above citation list, cuts in the c of corrugated cardboard sheets need to be engaged with each other to assemble the corrugated cardboard sheets in a matrix form, so that manpower and time required to prepare for a packing operation tend to increase. Moreover, it is difficult to reduce the number of corrugated cardboard sheets used while increasing protection of components, which is likely to put the vertical divider structure at a disadvantage in terms of the packing cost and the packaging weight. On the other hand, in the insert tray structure according to the above citation list, there is no need to assemble a plurality of corrugated cardboard sheets in a matrix form, and it is possible to improve packing workability and reduce the packing cost and the packaging weight as compared to the vertical divider structure.

However, it is necessary to form in advance the opening portions of a shape that fits each component, on the tray. Therefore, there is a problem that if there is a plurality of kinds of components to be packed, the work efficiency tends to decrease, and the packing cost also tends to increase. For example, if two kinds of components of which the three-dimensional shapes are mirror symmetric to each other are objects to be packed, it is necessary to prepare a tray appropriate for components of each kind, so that the packing cost increases. Moreover, it is necessary to insert an appropriate kind of components onto each tray and fix them thereon, so that manpower and time required to prepare for the packing operation increase.

One of objects of the present invention has been devised in light of the above problem, and is to provide a packaging structure that can improve workability and costs that are related to packing of components. Note that the present invention is not limited to this object, and to exert operations and effects that are derived from configurations presented in "DESCRIPTION OF PREFERRED EMBODIMENTS" described below and cannot be obtained by the known technology is also another object of the present invention.

Solutions to the Problems

A packaging structure of the disclosure can be achieved as aspects (application examples) disclosed below, and solves at least a part of the above problem. Any of Aspect 2 and subsequent aspects is an aspect that can be additionally selected as appropriate, and is an aspect that can be omitted. Any of Aspect 2 and the subsequent aspects does not disclose an aspect and configuration that are essential to the present invention.

Aspect 1. A packaging structure of the disclosure includes: a box in which a component is stored: and a holding member installed in the box, the holding member being configured to hold the component. The holding member includes: an undersurface portion that has a first opening portion into which the component is inserted and is placed on a bottom surface of the box: a top surface portion that has a second opening portion into which the component is inserted and is placed above the undersurface portion; and a first side surface portion connecting the undersurface portion and the top surface portion in an up-and-down direction. The holding member is formed by being bent along boundary lines between the first side surface portion, the undersurface portion, and the top surface portion, and is formed into two kinds of three-dimensional shapes that are mirror symmetric to each other, according to bending directions of the boundary lines.

Aspect 2. In the above aspect 1, it is preferable that the holding member include a second side surface portion that is provided separately from the first side surface portion and connects in the up-and-down direction between the undersurface portion and the top surface portion. Moreover, it is preferable that the holding member be formed into a rectangular tube shape by being bent along the boundary lines between the first side surface portion, the second side surface portion, the undersurface portion, and the top surface portion.

Aspect 3. In the above aspect 1 or 2, it is preferable that the top surface portion include first slits formed by making cuts in the top surface portion in straight lines. Moreover, it is preferable that the packaging structure include dividers configured to reinforce the holding member by being inserted into the first slits in such a manner as to contact the undersurface portion.

Aspect 4. In the above aspect 3, it is preferable that each of the dividers include a second slit formed by making a cut in the divider in a straight line. Moreover, it is preferable that a portion of the top surface portion where each of the first slits extends be inserted and fixed in the second slit, and a portion of each of the dividers where the second slit extends be inserted and fixed in the first slit.

Aspect 5. In the above aspect 4, it is preferable that the dividers include a first divider that is inserted from one end side of the top surface portion, and a second divider that is inserted from the other end side of the top surface portion.

Moreover, it is preferable that a predetermined gap be provided between an edge on the other end side of the first divider and an edge on the one end side of the second divider.

Aspect 6. In aspects including the above aspect 2, it is preferable that the holding member include protrusion/recess portions. It is preferable that the protrusion/recess portions be provided in places where the second side surface portion and the top surface portion or the undersurface portion are close to each other, with the holding member in a bent state, and be formed into protruding and recessed shapes that allow the second side surface portion and the top surface portion or the undersurface portion to mate together.

Aspect 7. In aspects including the above aspect 1, it is preferable that the holding member be made of a corrugated cardboard sheet of which a sheet width direction is parallel to an extension direction of the boundary lines.

Aspect 8. In aspects including the above aspect 3, it is preferable that the dividers be made of corrugated cardboard sheets, and be mounted on the top surface portion in such a manner that a sheet width direction of the corrugated cardboard sheets is oriented in the up-and-down direction.

Effects of the Invention

According to a packaging structure of the disclosure, two layers, that is, a top surface portion and an undersurface portion, hold a component. Therefore, it is possible to stably fix the component and improve the performance of holding and protecting the component. Moreover, by changing the bending direction, a holding member becomes reversible, and therefore, it is possible to improve workability and costs that are related to packing of the components.

DESCRIPTION OF PREFERRED EMBODIMENTS

1. Configuration

A packaging structure 5 as an example is described hereinafter. The packaging structure 5 is applicable to any kind of component. Examples of the component include various motors, driving units, reducers, gears, connection cables, controllers, sensors, and assembly units including them. In the present invention, the packaging structure 5 for storing a motor 4 with a reducer is illustrated by example. The motor 4 is a small DC electric motor with a reducer that is used as a drive source for, for example, a vehicle-mounted electrical component, an industrial machine, a precision machine, office equipment, a household electric appliance, a tool, a toy, or a model.

(A) Motor

Figure 8:
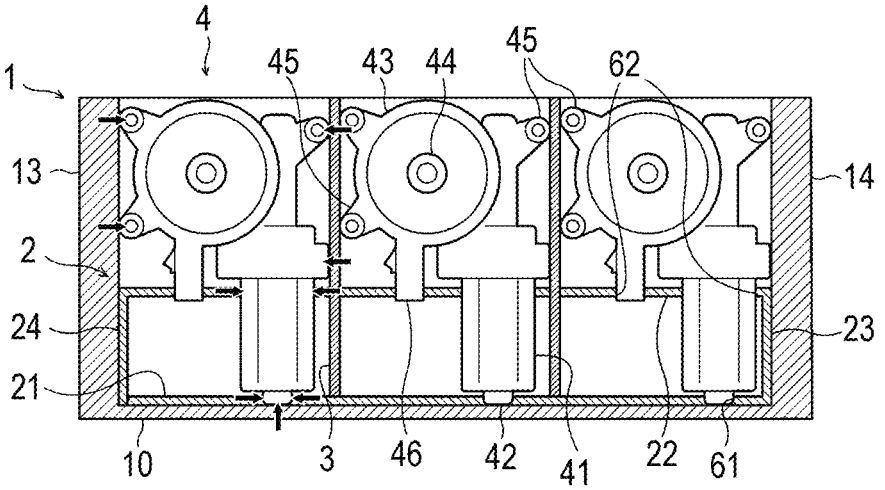
FIG. 8 is a cross-sectional view along A-A of FIG. 7.

As illustrated in FIG. 8, the motor 4 as an example of a component to which the packaging structure 5 is applicable is provided with a motor portion 41 and a reducer portion 43. The motor portion 41 is a portion that generates rotary power. The motor portion 41 has a structure in which an unillustrated rotor and stator are incorporated in a motor housing, and has, for example, a cylindrical shape. A connector portion 46 for connecting a wire harness is provided in the immediate neighborhood of the motor portion 41. Electric power and control signals for rotationally driving the rotor are supplied to the motor portion 41 via the wire harness.

An end portion of the motor portion 41 is provided with a protruding portion 42. The protruding portion 42 is a portion in which an end portion of a shaft of the rotor and a bearing (a bearing that supports the shaft in such a manner as to be rotatable relative to the motor housing) are incorporated. The protruding portion 42 is placed at a position corresponding to the axis of rotation of the rotor (on an end surface of the cylinder cylinder), and protrudes outward of the motor housing. The motor 4 of the present invention is packed with the protruding portion 42 facing down.

The reducer portion 43 is a portion that reduces the rotational speed of the rotary power generated by the motor portion 41, and outputs the power to an output shaft 44. The reducer portion 43 has a structure in which an unillustrated reduction mechanism (gear) is incorporated in a reducer case, and has, for example, a flat cylindrical (disc) shape. The output shaft 44 and the reduction mechanism are supported via an unillustrated bearing in such a manner as to be rotatable relative to the reducer case. The output shaft 44 is placed at a position corresponding to the axis of rotation of the reduction mechanism (a cylindrical axis portion), and extends outward of the reducer case. Moreover, a plurality of mounting legs 45 is provided on an outer peripheral surface of the reducer portion 43, extending out therefrom. The mounting legs 45 are boss-shaped portions on each of which a fastening device (such as a bolt, a nut, a screw, a rivet, or a clip) for fixing the motor 4 to an object to be mounted is mounted.

The packaging structure 5 of the present invention has a structure that can accommodate not only the motor 4 of the shape illustrated in FIG. 8 but also the motor 4 of which the three-dimensional shape is mirror symmetric to the motor 4 of the shape illustrated in FIG. 8. The motor 4 of the shape illustrated in FIG. 8 is referred to as the "L-shaped motor 4," and the motor 4 of the mirror symmetric shape is referred to as the "R-shaped motor 4." In the present invention, when the protruding portion 42 is oriented downward of the motor portion 41 as the reducer portion 43 is viewed from the output shaft 44, the L-shaped motor 4 is a motor of which the entire shape is similar to the letter q, and the R-shaped motor 4 is a motor of which the entire shape is similar to the letter p.

(B) Box

Figure 1:
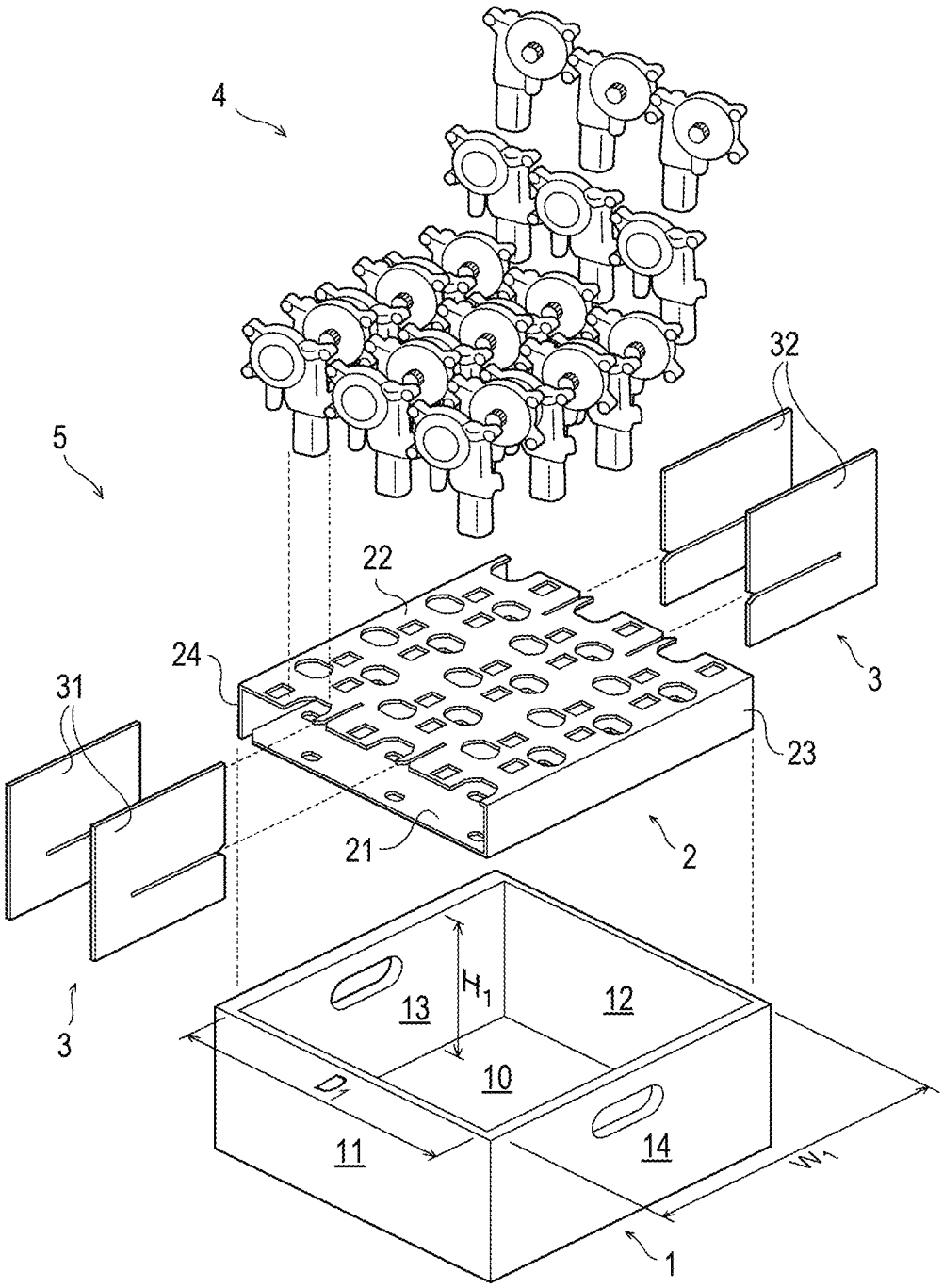
FIG. 1 is an exploded perspective view for explaining a packaging structure as an example.

FIG. 1 is an exploded perspective view of the packaging structure 5 in which the motor 4 is stored. The packaging structure 5 includes a box 1, a holding member 2, and a divider 3. The holding member 2 and the divider 3 are support members that suppress backlash and movements of the motor 4 and stably support the motor 4 during transportation of the box 1 in which the motor 4 is stored, and that dampen external force that may act on the motor 4. The holding member 2 and the divider 3 are formed of corrugated cardboard sheets. Examples of the corrugated cardboard sheets include corrugated paper cardboard and corrugated plastic cardboard that are formed into sheets. Moreover, the box 1 is simply required to be formed of a material that is excellent in terms of the total packaging weight and the shape stability from the viewpoint of transporting the motor 4, and may be formed of, for example, a corrugated cardboard sheet or another material.

The box 1 is a flat cuboid container (a drawer type interior box or carton) of which the top surface is open. The box 1 includes a box bottom surface 10 and four box side surfaces 11 to 14 standing upward respectively on four outer peripheral sides surrounding the box bottom surface 10. In the example illustrated in FIG. 1, a dimension (width) between the first box side surface 11 and the second box side surface 12 is $W_1$, a dimension (depth) between the third box side surface 13 and the fourth box side surface 14 is $D_1$, and the inside height is $H_1$. A hand hole is formed in each of a pair of the opposing box side surfaces 13 and 14, considering ease of manual transportation of the box 1. Moreover, the holding member 2 is installed in the box 1 and the motor 4 is stored on the holding member 2. The box 1 illustrated in FIG. 1 can store 24 motors 4. The box 1 in which the motors 4 are stored is transported, for example, in a stacked manner on a pallet, or a plurality of the boxes 1 is transported, stored in another unillustrated outer box.

(C) Holding Member

Figure 2:
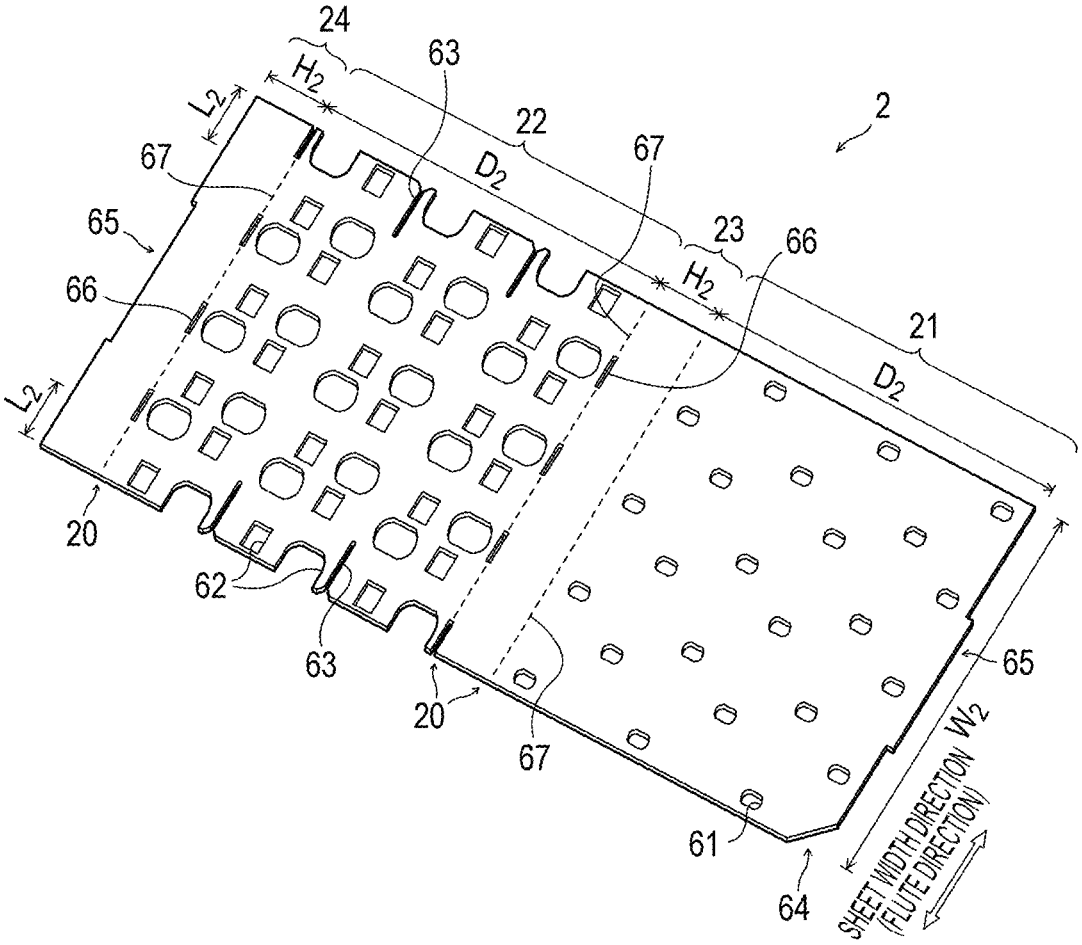
FIG. 2 is a perspective view (developed view) illustrating a state before bending a holding member of FIG. 1.

The holding member 2 is a member that is installed inside the box 1 and holds the motor 4, and is formed by bending a corrugated cardboard sheet (a rectangular sheet member). FIG. 2 is a perspective view (developed view) illustrating a state before bending the holding member 2. The holding member 2 of the present invention includes an undersurface portion 21, a top surface portion 22, a first side surface portion 23, and a second side surface portion 24, and is formed into a rectangular tube shape by being bent along boundary lines 20 therebetween. However, the second side surface portion 24 may be omitted.

The undersurface portion 21 is a flat portion placed on the box bottom surface 10. A plurality of first opening portions 61 is formed in the undersurface portion 21. Each of the first opening portions 61 is a hole through which the protruding portion 42 of the motor 4 is inserted to fasten the protruding portion 42, and functions in such a manner as to support the immediate neighborhood of a lower end portion of the motor 4 stored in the box 1. The undersurface portion 21 of the present invention is provided in such a manner as to contact the box bottom surface 10 when the holding member 2 is installed in the box 1. The depth of the first opening portions 61 (the thickness of the undersurface portion 21) may be set to be, for example, substantially equal to the length of protrusion of the protruding portions 42, or may be set to a dimension less than the length of protrusion of the protruding portions 42.

A dimension $W_2$ indicated in FIG. 2 is a dimension (width) of an edge of the undersurface portion 21 that comes close to the fourth box side surface 14 when the holding member 2 is installed in the box 1. The dimension $W_2$ is set to a dimension corresponding to (for example, substantially the same dimension as, or a slightly smaller dimension than) the width $W_1$ of the box 1. Similarly, a dimension $D_2$ indicated in FIG. 2 is a dimension (depth) of an edge of the undersurface portion 21 that comes close to the second box side surface 12 when the holding member 2 is installed in the box 1. The dimension $D_2$ is set to a dimension corresponding to (for example, the substantially same dimension as, or a slightly smaller dimension than) the depth $D_1$ of the box 1.

The top surface portion 22 is a flat portion that is placed above the undersurface portion 21 when the holding member 2 is in the bent state. The outline shape of the top surface portion 22 is assumed to be a shape corresponding to (substantially the same shape as) the undersurface portion 21 in top view when the holding member 2 is in the bent state. A plurality of second opening portions 62 is formed in the top surface portion 22. Each of the second opening portions 62 is a hole through which the motor portion 41 and the connector portion 46 are inserted, and functions in such a manner as to support the vicinity of the central portion in an up-and-down direction of the motor 4 stored in the box 1. Note that it is preferable that the motor portion 41 of which the weight is relatively heavy is fixed, fitting tightly in the second opening portion 62. On the other hand, the connector portion 46 of which the weight is relatively light may fit loosely in the second opening portion 62, or may not contact the second opening portion 62.

The first side surface portion 23 is a flat portion that connects the undersurface portion 21 and the top surface portion 22 in the up-and-down direction when the holding member 2 is in the bent state. The boundary line 20 between the first side surface portion 23 and the undersurface portion 21 is straight, and the boundary line 20 between the first side surface portion 23 and the top surface portion 22 is also straight. The boundary lines 20 are placed parallel. A dimension $H_2$ indicated in FIG. 2 corresponds to a separation dimension between the undersurface portion 21 and the top surface portion 22, and is set to be less than the inside height $H_1$ of the box 1. The first side surface portion 23 of the present invention is provided in such a manner as to come into surface contact with the third box side surface 13 or the fourth box side surface 14 when the holding member 2 is installed in the box 1. Note that it is preferable that the sheet width direction (flute direction) of the corrugated cardboard sheet forming the holding member 2 be parallel to the extension direction of the boundary lines 20.

The second side surface portion 24 is a portion provided separately from the first side surface portion 23, and is a flat portion that connects the undersurface portion 21 and the top surface portion 22 in the up-and-down direction after the holding member 2 is bent. The second side surface portion 24 is provided, for example, at a position opposite to the first side surface portion 23 across the undersurface portion 21 or the top surface portion 22 before the holding member 2 is bent. The second side surface portion 24 illustrated in FIG. 2 is placed at a position opposite to the first side surface portion 23 across the top surface portion 22. The boundary line 20 between the top surface portion 22 and the second side surface portion 24 is straight, and is placed parallel to the boundary line 20 between the first side surface portion 23 and the top surface portion 22. The width ($H_2$) of the second side surface portion 24 is substantially the same dimension as the width ($H_2$) of the first side surface portion 23.

Cuts 66 and perforations 67 for facilitating bending the sheet may be formed in the boundary lines 20 between the undersurface portion 21, the top surface portion 22, the first side surface portion 23, and the second side surface portion 24. The cuts 66 are formed as, for example, discontinuous lines along the boundary lines 20 in such a manner as to penetrate the sheet from the front side to the back side. The perforations 67 are formed as, for example, discontinuous lines along the boundary lines 20 with a shorter pitch than that of the cuts 66. Note that the perforations 67 may be formed with a depth that penetrates the sheet from the front side to the back side, or may be made with a depth that does not penetrate the sheet completely from the front side to the back side. Moreover, the perforations 67 may be made on a single side, the front side or the back side, or may be made on both the front side and the back side.

Figure 3:
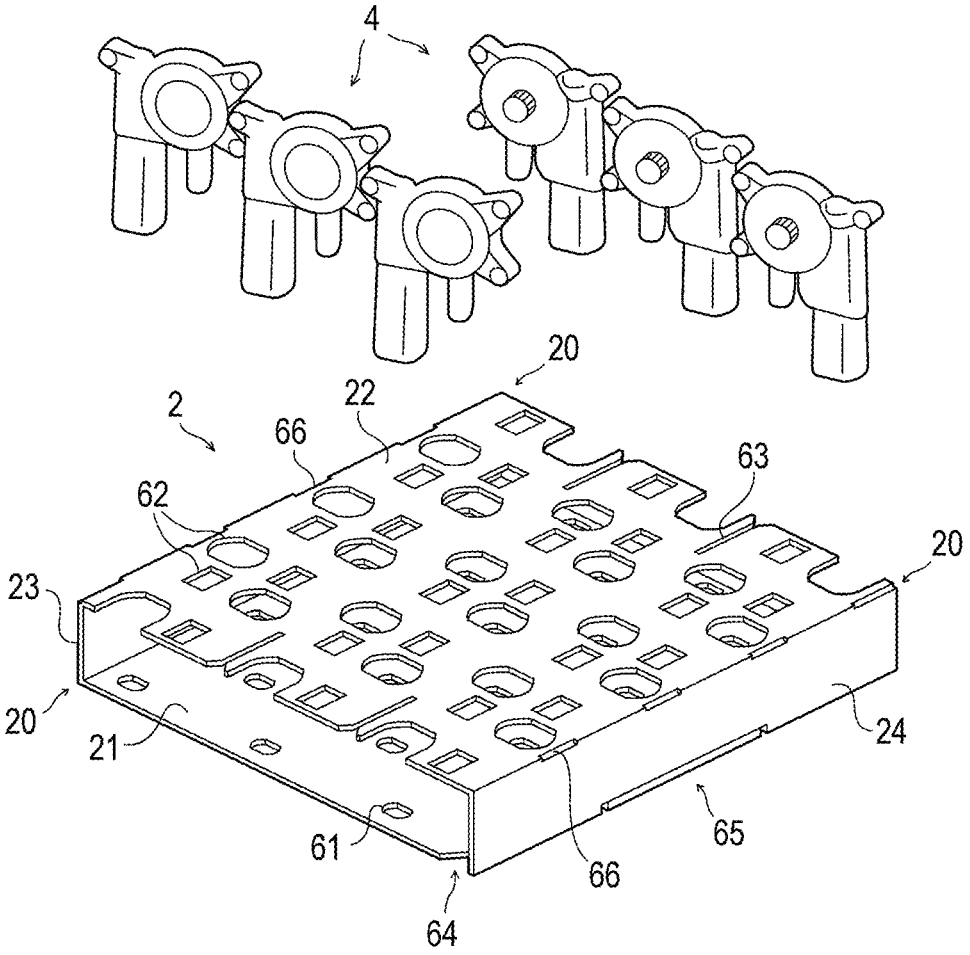
FIG. 3 is a perspective view illustrating a state after bending the holding member of FIG. 2.
Figure 4:
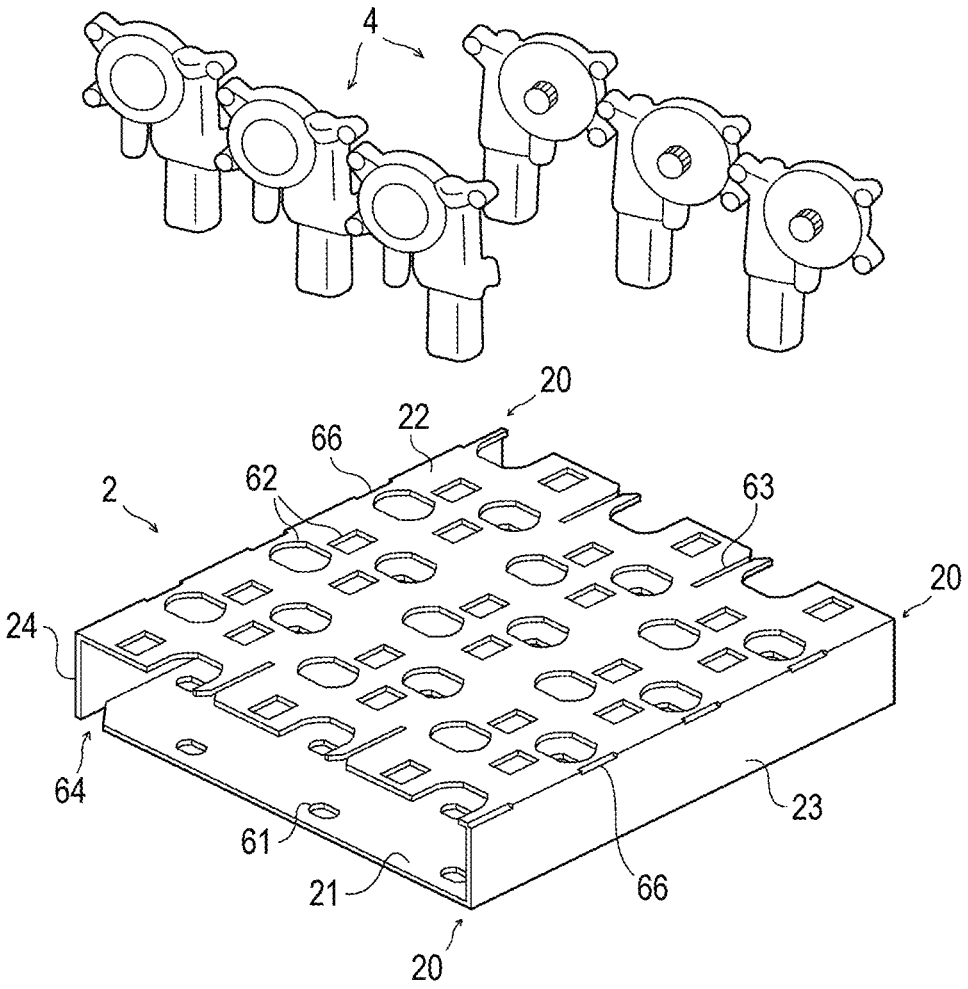
FIG. 4 is a perspective view illustrating a state after bending the holding member of FIG. 2.

The above holding member 2 is reversible, and is formed into two kinds of three-dimensional shapes that are mirror symmetric to each other, according to the bending directions of the boundary lines 20 illustrated in FIG. 2. For example, the holding member 2 is bent upward at 90° along three boundary lines 20 illustrated in FIG. 2 to complete the holding member 2 having the shape illustrated in FIG. 3. The holding member 2 illustrated in FIG. 3 is formed by being bent along the boundary lines 20 in such a manner that the top side of the undersurface portion 21 faces the top side of the top surface portion 22 in FIG. 2. The L-shaped motors 4 are held in the first opening portions 61 and the second opening portions 62 of the holding member 2. On the other hand, the holding member 2 is bent downward at 90° along the three boundary lines 20 illustrated in FIG. 2 to complete the holding member 2 having the shape illustrated in FIG. 4. The holding member 2 illustrated in FIG. 4 is formed by being bent along the boundary lines 20 in such a manner that the underside of the undersurface portion 21 faces the underside of the top surface portion 22 in FIG. 2. The R-shaped motors 4 are held in the first opening portions 61 and the second opening portions 62 of the holding member 2.

Figure 5A:
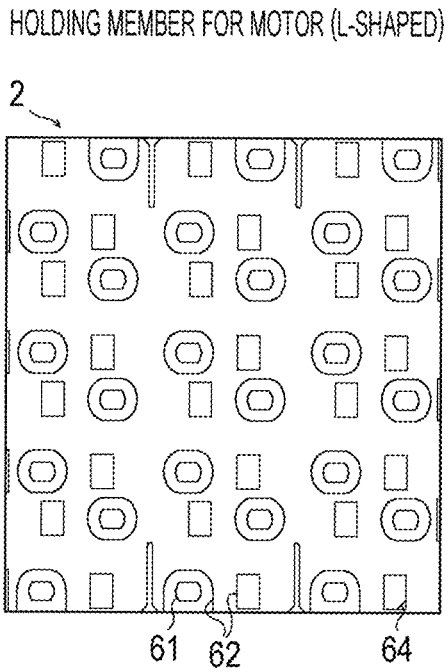
FIG. 5A is a top view of the holding member of FIG. 3.
Figure 5B:
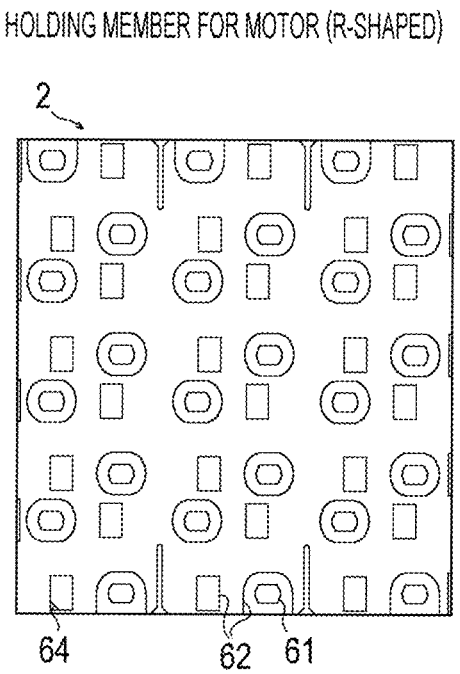
FIG. 5B is a top view of the holding member of FIG. 4.

FIG. 5A is a top view of the holding member 2 illustrated in FIG. 3, and FIG. 5B is a top view of the holding member 2 illustrated in FIG. 4. In both views of the holding member 2, the first opening portions 61 are located inside the second opening portions 62 in top view. Moreover, the layouts of the first opening portions 61 and the second opening portions 62 are symmetric with respect to a line in top view, and are three-dimensionally mirror symmetric. Consequently, it is configured in such a manner that the two kinds of the motors 4 of which the three-dimensional shapes are mirror symmetric are stored in their corresponding holding members 2 and stably held therein.

As illustrated in FIGS. 2 to 4, the top surface portion 22 is provided with first slits 63 where the dividers 3 are inserted and fixed. The first slits 63 are formed by making cuts in two of four sides surrounding the top surface portion 22, to which the first side surface portion 23 and the second side surface portion 24 are not connected, in straight lines extending inward in the top surface portion 22. A dimension $L_2$ indicated in FIG. 2 is the length of the first slits 63. In the present invention, four first slits 63 are provided. Two of the four first slits 63 are formed by making cuts in an edge of the top surface portion 22 that comes close to the first box side surface 11, and the remaining two are formed by making cuts in an edge of the top surface portion 22 that comes close to the second box side surface 12. The latter two are placed on extension lines of the former two, respectively.

A chamfered portion 64 as a mark for identifying the orientation and front and back sides of the holding member 2 during the bending operation is provided at any given position of the holding member 2. In the example illustrated in FIG. 2, the chamfered portion 64 is formed which has a shape obtained by cutting away an end corner of the undersurface portion 21. At the time of the bending operation of the holding member 2, the holding member 2 is placed in landscape orientation in such a manner that the chamfered portion 64 is located, for example, on the right side and on the front side as viewed from a worker to bend the holding member 2 upward along the boundary lines 20. Therefore, the holding member 2 of the shape illustrated in FIG. 3 can be manufactured. Moreover, if the holding member 2 of the shape illustrated in FIG. 4 is manufactured, it is simply required to place the holding member 2 in landscape orientation in such a manner that the chamfered portion 64 is located, for example, on the left side and on the front side as viewed from the worker to bend the holding member 2 upward along the boundary lines 20. In this manner, the chamfered portion 64 is used as a mark to prevent mistakes in the bending operation.

As illustrated in FIGS. 2 and 3, protrusion/recess portions 65 are provided in places where the second side surface portion 24 and the undersurface portion 21 are close to each other when the holding member 2 is in the bent state. The protrusion/recess portions 65 are formed into protruding and recessed shapes that allow the second side surface portion 24 and the undersurface portion 21 to mate together. For example, the protrusion/recess portion 65 of the undersurface portion 21 is formed in a shape that projects by the thickness of the second side surface portion 24 from the edge of the undersurface portion 21, and the protrusion/recess portion 65 of the second side surface portion 24 is formed in a shape that is recessed by the thickness of the undersurface portion 21. Such protrusion/recess portions 65 are provided to enhance the shape stability of the bent holding member 2. Note that the shape of the protrusion/recess portion 65 of the undersurface portion 21 may not fit perfectly to the shape of the protrusion/recess portion 65 of the second side surface portion 24, or may be a shape that is engaged with the protrusion/recess portion 65 of the second side surface portion 24 at an appropriate level.

(D) Divider

As illustrated in FIG. 1, the dividers 3 are mounted in the first slits 63, respectively. The dividers 3 are sheet members for reinforcing the holding member 2, and are inserted and fixed in the first slits 63 in such a manner as to contact the undersurface portion 21. The dividers 3 that are inserted into the first slits 63, which are located close to the first box side surface 11, of the top surface portion 22 are first dividers 31. The dividers 3 that are inserted into the first slits 63, which are located close to the second box side surface 12, of the top surface portion 22 are second dividers 32. The first dividers 31 are mirror symmetric to the second dividers 32. The first dividers 31 are inserted from one end side (for example, the first box side surface 11 side) of the top surface portion 22, and fixed therein. The second dividers 32 are inserted from the other end side (for example, the second box side surface 12 side) of the top surface portion 22, and fixed therein.

Figure 6:
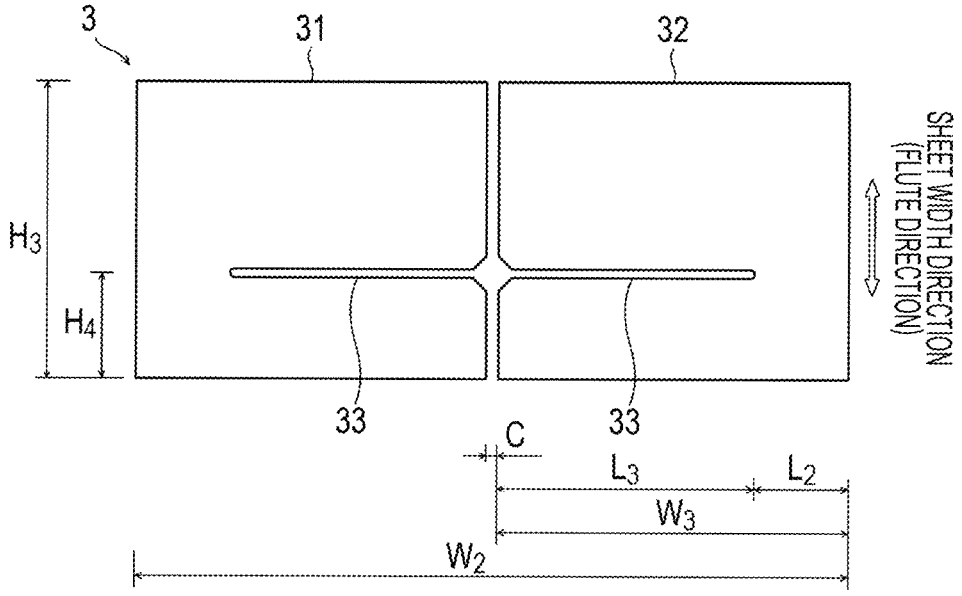
FIG. 6 is a side view of dividers of FIG. 1.

FIG. 6 is a side view of the dividers 3 (the first divider 31 and the second divider 32). Each of the dividers 3 is provided with a second slit 33. Each of the second slits 33 is formed by making a cut in a straight line extending outward in the top surface portion 22 from an edge of the divider 3 located inward in the top surface portion 22 when the divider 3 is in the state of being inserted and fixed in the top surface portion 22. A dimension $L_3$ indicated in FIG. 6 is the length of the second slits 33, and a dimension $W_3$ is the length (width) of the dividers 3. In the present invention, the dimensions $W_3$, $L_2$, and $L_3$ are set in such a manner that $W_3=L_2+L_3$ holds.

A portion of the top surface portion 22 where each of the first slits 63 extends is inserted and fixed in the second slit 33 of the divider 3. Similarly, a portion of each of the dividers 3 where the second slit 33 extends is inserted and fixed in the first slit 63 of the top surface portion 22. Consequently, it is structured in such a manner that each of the dividers 3 and the top surface portion 22 are partially held between each other, so that the stiffness and shape stability of the holding member 2 are enhanced. Note that it is preferable that the sheet width direction (flute direction) of the corrugated cardboard sheet forming each of the dividers 3 be the up-and-down direction when each of the dividers 3 is in the state of being inserted and fixed in the top surface portion 22.

A dimension $H_3$ indicated in FIG. 6 is the height of the dividers 3. The dimension $H_3$ is set to a dimension corresponding to (for example, substantially the same dimension as, or a slightly smaller dimension than) the inside height $H_1$ of the box 1. Moreover, a dimension $H_4$ indicated in FIG. 6 is a distance in the height direction from the lower side of each of the dividers 3 to the second slit 33. The dimension $H_4$ is set to a dimension corresponding to (for example, substantially the same dimension as, or a slightly smaller dimension than) the width $H_2$ of the first side surface portion 23 and the second side surface portion 24.

As illustrated in FIG. 6, a predetermined gap is formed between the first divider 31 and the second divider 32 when the first divider 31 and the second divider 32 are in the state of being inserted and fixed in the top surface portion 22. A dimension C of FIG. 6 is the dimension of the gap. The gap is provided, so that it is possible to prevent interference between the adjacent first divider 31 and second divider 32 and to insert and fix the dividers 3 deeply and reliably in the top surface portion 22. In the present invention, the dimensions C, $W_2$, and $W_3$ are set in such a manner that $W_2=C+2W_3$. An edge opposite to the gap among the edges of each of the dividers 3 is in contact with the first box side surface 11 or the second box side surface 12 of the box 1. The first divider 31 is held between the first box side surface 11 and the holding member 2 and stably fixed. The second divider 32 is held between the second box side surface 12 and the holding member 2 and stably fixed.

2. Stored State

Figure 7:
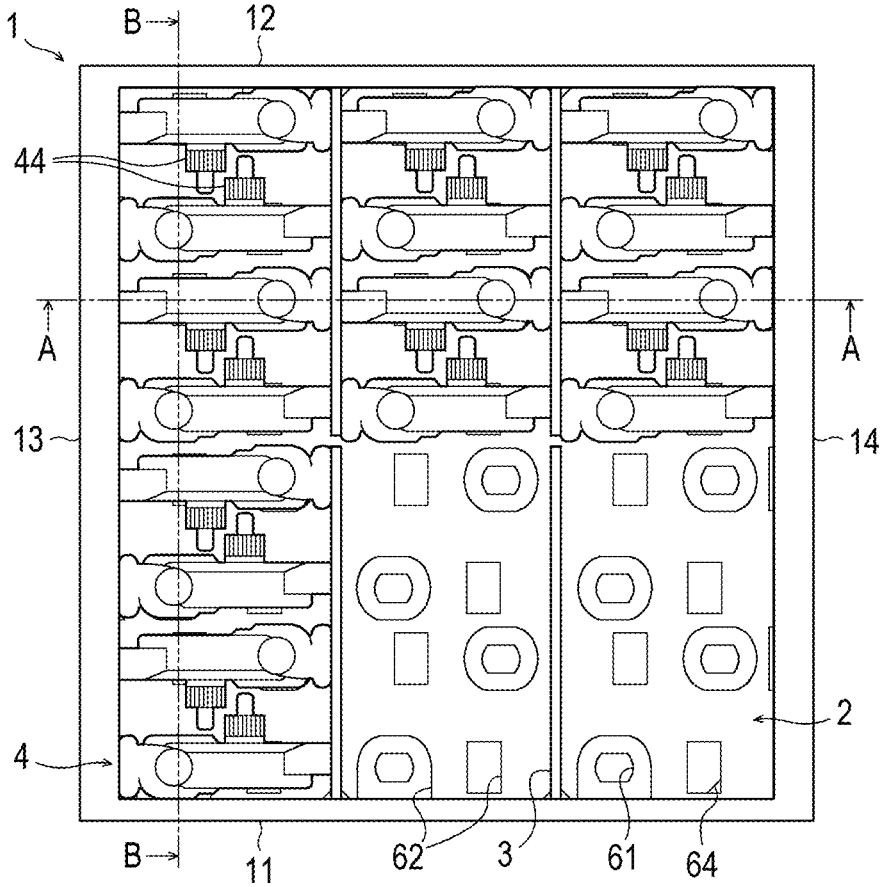
FIG. 7 is a top view of a box in which components are stored.

FIG. 7 is a top view of the box 1 in which the L-shaped motors 4 are stored. The motors 4 of FIG. 7 are stored, three in the lateral direction (row direction) and eight in the longitudinal direction (column direction). The motors 4 included in odd-numbered rows from the top in FIG. 7 are stored in a face-down orientation in FIG. 7 in such a manner that the output shafts 44 face the first box side surface 11. On the other hand, the motors 4 included in even-numbered rows from the top in FIG. 7 are stored in a face-up orientation in FIG. 7 (in an orientation in which the motors 4 included in the odd-numbered rows are rotated 180° in the horizontal direction) in such a manner that the output shafts 44 face the second box side surface 12. In this manner, components having the same shape are placed face-to-face in such a manner as to be paired to increase the space volume ratio (the ratio of the volume of the box 1 to the volume of components).

Figure 9:
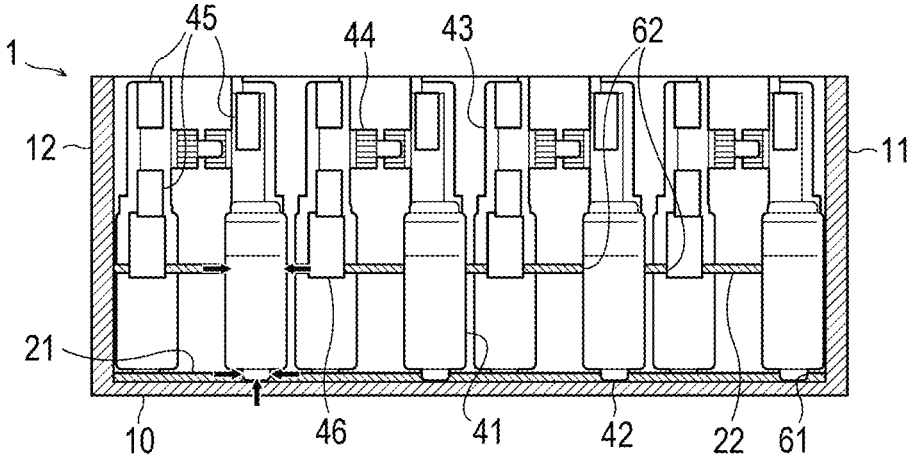
FIG. 9 is a cross-sectional view along B-B of FIG. 7.

FIG. 8 is a cross-sectional view along A-A of FIG. 7. FIG. 9 is a cross-sectional view along B-B of FIG. 7. Black arrows in FIGS. 8 and 9 represent the supporting force of the box 1 and the holding member 2 to support the motor 4. The motor portions 41 of the motors 4 are supported in the horizontal direction by end surfaces of the second opening portions 62, and the upper parts of the motor portions 41 are supported in the horizontal direction by the third box side surface 13, the fourth box side surface 14, and the dividers 3. On the other hand, the protruding portions 42 located at the lower end portions of the motor portions 41 are supported in the vertical direction by the box bottom surface 10 and are supported in the horizontal direction by end surfaces of the first opening portions 61. In this manner, the motor portions 41 that are close to the centers of gravity are placed substantially perpendicularly, and support points of the motors 4 by the undersurface portion 21 and support points of the motors 4 by the top surface portion 22 are arranged in the up-and-down direction to enhance the stability of the motors 4 against horizontal shaking.

In the reducer portions 43 of the motors 4, the mounting legs 45 provided to the outer peripheral surfaces of the reducer portions 43 are supported in the horizontal direction by the third box side surface 13, the fourth box side surface 14, and the dividers 3. In this manner, the mounting legs 45 away from the centers of gravity are supported. Therefore, the falls and displacement of the motors 4 are effectively prevented, and the stability of the motors 4 against horizontal shaking is further enhanced. Moreover, as illustrated in FIG. 8, the mounting legs 45 of the motors 4 adjacent in the lateral direction (row direction) sandwich the divider 3, so that the dividers 3 are firmly fixed, and the stability of the motors 4 against horizontal shaking is further enhanced.

3. Effects (1) The above packaging structure 5 includes: the box 1 in which the motor 4 is stored; and the holding member 2 that is installed in the box 1 and holds the motor 4. The holding member 2 includes: the undersurface portion 21 in which the first opening portion 61 into which the motor 4 is inserted is formed and that is placed on the box bottom surface 10; the top surface portion 22 in which the second opening portion 62 into which the motor 4 is inserted is formed and that is placed above the undersurface portion 21: and the first side surface portion 23 that connects the undersurface portion 21 and the top surface portion 22 in the up-and-down direction. Moreover, the holding member 2 is formed by being bent along the boundary lines 20 between the first side surface portion 23, the undersurface portion 21, and the top surface portion 22, and is formed into the two kinds of three-dimensional shapes that are mirror symmetric to each other, according to the bending directions of the boundary lines 20.

In this manner, the motor 4 is held by two layers—the undersurface portion 21 and the top surface portion 22. Therefore, it is possible to stably fix the motor 4 and improve the performance of holding and protecting the motor 4. Moreover, a change in the bending direction of the boundary lines 20 makes it possible to easily achieve the two different structures (the reversible structure) that are mirror symmetric to each other. Consequently, it is possible to easily achieve the packaging structure 5 that is adaptable for two kinds of components of which the three-dimensional shapes are mirror symmetric and to make, for example, one holding member 2 adaptable for both the L-shaped motor 4 and the R-shaped motor 4. Therefore, it is possible to improve workability and costs that are related to packing of the components. Furthermore, the procedure for achieving the two-way packaging structure is very easy, and simply requires changing the bending direction of the boundary lines 20 at the time of the assembly operation of the holding member 2. Consequently, it is possible to further enhance workability and cost performance that are related to packing.

(2) As illustrated in FIG. 2, in the above packaging structure 5, the holding member 2 includes the second side surface portion 24. The second side surface portion 24 is provided separately from the first side surface portion 23, and connects in the up-and-down direction between the undersurface portion 21 and the top surface portion 22. Moreover, the holding member 2 is formed into a rectangular tube shape by being bent along the boundary lines 20 between the first side surface portion 23, the second side surface portion 24, the undersurface portion 21, and the top surface portion 22. In this manner, the holding member 2 is provided with the second side surface portion 24 to form the holding member 2 into a rectangular tube shape. Therefore, it is possible to increase stiffness and shape stability and improve the performance of holding and protecting the motor 4. Moreover, these effects can be obtained from both of the two different structures as the reversible structure. In other words, it is possible to improve the stiffness and shape stability of the holding member 2 while achieving the reversible structure.

(3) As illustrated in FIG. 2, the top surface portion 22 includes the first slits 63 making cuts in the top surface portion 22 in straight lines. Moreover, the above packaging structure 5 includes the dividers 3 that are inserted into the first slits 63 in such a manner as to contact the undersurface portion 21 to reinforce the holding member 2. In this manner, the dividers 3 are inserted into the first slits 63 of the top surface portion 22 for reinforcement. Therefore, it is possible to increase the stiffness and shape stability of the holding member 2 and improve the performance of holding and protecting the motor 4. Moreover, it is possible to cause the dividers 3 to function as bracing walls against a vertical load in the box 1. Consequently, for example, even if the boxes 1 are stacked in the up-and-down direction, the lower-row boxes 1 resist being crushed. Therefore, it is possible to further improve the performance of holding and protecting the motor 4.

(4) As illustrated in FIG. 6, each of the dividers 3 includes the second slit 33 formed by making a cut in the divider 3 in a straight line. Moreover, the portion of the top surface portion 22 where each of the first slits 63 extends is inserted and fixed in the second slit 33. The portion of each of the dividers 3 where the second slit 33 extends is inserted and fixed in the first slit 63. In this manner, the top surface portion 22 is inserted into the second slits 33 of the dividers 3 for reinforcement. Therefore, it is possible to increase the stiffness and shape stability of the dividers 3 and further improve the performance of holding and protecting the motor 4. Moreover, the dividers 3 prevent the top surface portion 22 from deforming in the thickness direction. The top surface portion 22 prevents the dividers 3 from deforming in the thickness direction. Therefore, it is possible to increase the stiffness and shape stability of the holding member 2 as a synergistic effect.

(5) As illustrated in FIG. 6, the dividers 3 include the first divider 31 that is inserted from the one end side of the top surface portion 22, and the second divider 32 that is inserted from the other end side of the top surface portion 22. Moreover, the predetermined gap is provided between the edge on the other end side of the first divider 31 and the edge on the one end side of the second divider 32 when the dividers 3 are in the state of being inserted and fixed in the top surface portion 22. Consequently, it is possible to prevent interference between the dividers 3, and stabilize the fixed state of the dividers 3 and the top surface portion 22. Therefore, it is possible to further improve the performance of holding and protecting the motor 4.

(6) As illustrated in FIG. 2, the holding member 2 includes the protrusion/recess portions 65. The protrusion/recess portions 65 are provided in the places where the second side surface portion 24 and the undersurface portion 21 are close to each other when the holding member 2 is in the bent state. The protrusion/recess portions 65 are formed into the protruding and recessed shapes that allow the second side surface portion 24 and the undersurface portion 21 to mate together. Such protrusion/recess portions 65 are provided. Therefore, it is possible to increase the stiffness and shape stability of the bent holding member 2 and further improve the performance of holding and protecting the motor 4.

(7) The above holding member 2 is formed of a corrugated cardboard sheet of which the sheet width direction (flute direction) is parallel to the extension direction of the boundary lines 20. With such a configuration, it is possible to easily bend the holding member 2 on the boundary lines 20 along the flutes, and improve workability related to assembly of the holding member 2.

(8) The above dividers 3 are formed of corrugated cardboard sheets, and are mounted on the top surface portion 22 in such a manner that the sheet width direction (flute direction) of the dividers 3 is oriented in the up-and-down direction. With such a configuration, it is possible to increase the stiffness and shape stability of the dividers 3 against a load in the up-and-direction and further improve the performance of holding and protecting the motor 4.

4. Others

The above example is a mere example, and is not intended to preclude various modifications and application of a technology, which are not explicitly stated in the example. The configurations of the example can be modified in various manners within the scope that does not depart from the purport of the configurations, and can be carried out. Moreover, a selection can be made from the configurations of the example as needed, or the configurations of the example can be combined with various configurations included in the known technology as appropriate.

In the above example, the holding member 2 provided with the undersurface portion 21, the top surface portion 22, the first side surface portion 23, the second side surface portion 24 is illustrated by example. However, the holding member 2 is simply required to include at least the undersurface portion 21, the top surface portion 22, and the first side surface portion 23. With such a configuration, it is possible to achieve the holding member 2 with the reversible structure including the structures that are mirror symmetric to each other, according to the bending directions of the boundary lines 20, and to obtain operations and effects similar to the above example. Note that in this case, it may be configured in such a manner that an open end portion of the top surface portion 22 is configured in such a manner as to be fastened to the third box side surface 13 or the fourth box side surface 14, or a member that functions as a support in some way may be interposed between the undersurface portion 21 and the top surface portion 22.

Figure 10A:
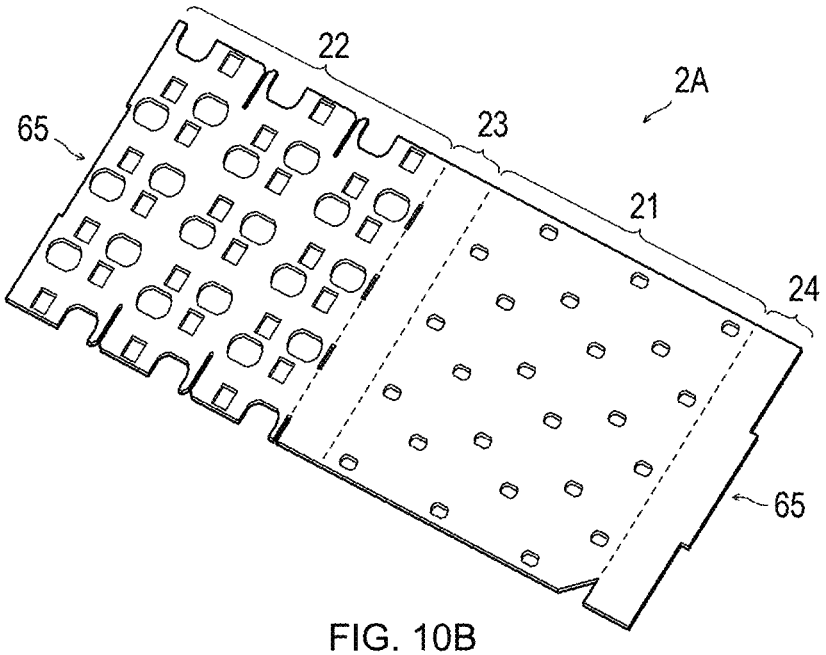
FIGS. 10A and 10B are perspective views illustrating a holding member as a modification.

In the above example, the holding member 2 in which the first side surface portion 23 and the second side surface portion 24 are placed in such a manner as to be adjacent to the top surface portion 22 is illustrated by example. However, the first side surface portion 23 and the second side surface portion 24 may be placed in such a manner as to be adjacent to the undersurface portion 21. In a holding member 2A illustrated in FIG. 10A, the second side surface portion 24 is placed at a position opposite to the first side surface portion 23 across the undersurface portion 21. Moreover, the protrusion/recess portions 65 are provided in places where the second side surface portion 24 and the top surface portion 22 are close to each other when the holding member is in the bent state. The protrusion/recess portions 65 are formed into protruding and recessed shapes that allow the second side surface portion 24 and the top surface portion 22 to mate together. With such a configuration, it is possible to achieve substantially the same reversible structure as the above example.

Figure 10B:
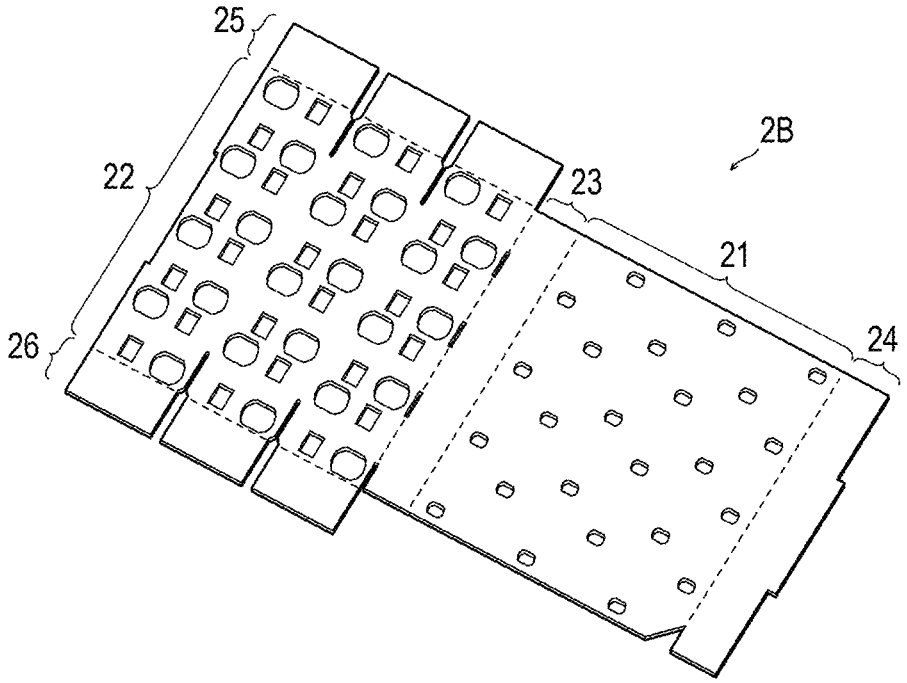

In the above example, as illustrated in FIGS. 3 and 4, the holding member 2 of a rectangular tube shape including the four surfaces 21 to 24 is illustrated by example. However, the shape of the holding member 2 is not limited to a rectangular tube shape. For example, as illustrated in FIG. 10B, a third side surface portion 25 and a fourth side surface portion 26 are placed in such a manner as to be adjacent to the top surface portion 22 to form a box-shaped holding member 2B including six surfaces 21 to 26. In this case, the third side surface portion 25 and the fourth side surface portion 26 may be provided with slits for preventing interference with the dividers 3. With such a configuration, it is possible to increase the stiffness and shape stability of the holding member 2 and improve the performance of holding and protecting the motor 4.

In the above example, the first opening portions 61 and the second opening portions 62 have simple hole shapes. However, it may be configured in such a manner that a tab (a flat projection) protrudes from an edge of each of the opening portions 61 and 62. Consequently, it is possible to increase the contact area between the motor 4 and the holding member 2 and enhance the performance of holding and protecting the motor 4. Moreover, the tabs formed at the edges of the opening portions 61 and 62 work in such a manner as to guide the storage positions of the motors 4 during the insertion operation of the motors 4, so that it is possible to further improve workability related to packing.

INDUSTRIAL APPLICABILITY

The present invention can be used in a component manufacturing industry and an industry that manufactures packing materials for packing components.

The invention claimed is:

1. A packaging structure comprising:

a box in which a component is stored; and a holding member installed in the box, the holding member being configured to hold the component, wherein the holding member includes:

an undersurface portion that has a first opening portion into which the component is inserted and is placed on a bottom surface of the box;

a top surface portion that has a second opening portion into which the component is inserted and is placed above the undersurface portion;

and a first side surface portion connecting the undersurface portion and the top surface portion in an up-and-down direction, and wherein the holding member is formed by being bent along boundary lines between the first side surface portion, the undersurface portion, and the top surface portion, and the holding member is formable into two kinds of three-dimensional shapes that are mirror symmetric to each other, according to bending directions of the boundary lines.

2. The packaging structure according to claim 1, wherein the holding member includes a second side surface portion that is provided separately from the first side surface portion and connects in the up-and-down direction between the undersurface portion and the top surface portion, and is formed into a rectangular tube shape by being bent along the boundary lines between the first side surface portion, the second side surface portion, the undersurface portion, and the top surface portion.

3. The packaging structure according to claim 1, wherein the top surface portion includes first slits formed by making cuts in the top surface portion in straight lines, and the packaging structure comprises dividers configured to reinforce the holding member by being inserted into the first slits in such a manner as to contact the undersurface portion.

4. The packaging structure according to claim 3, wherein each of the dividers includes a second slit formed by making a cut in the divider in a straight line, and a portion of the top surface portion where each of the first slits extends is inserted and fixed in the second slit, and a portion of each of the dividers where the second slit extends is inserted and fixed in the first slit.

5. The packaging structure according to claim 4, wherein the dividers include a first divider that is inserted from one end side of the top surface portion, and a second divider that is inserted from the other end side of the top surface portion, and a predetermined gap is provided between an edge on the other end side of the first divider and an edge on the one end side of the second divider.

6. The packaging structure according to claim 2, wherein the holding member includes protrusion/recess portions that are provided in places where the second side surface portion and the top surface portion or the undersurface portion are close to each other, with the holding member in a bent state, and that are formed into protruding and recessed shapes that allow the second side surface portion and the top surface portion or the undersurface portion to mate together.

7. The packaging structure according to claim 1, wherein the holding member is made of a corrugated cardboard sheet of which a sheet width direction is parallel to an extension direction of the boundary lines.

8. The packaging structure according to claim 3, wherein the dividers are made of corrugated cardboard sheets, and are mounted on the top surface portion in such a manner that a sheet width direction of the corrugated cardboard sheets is oriented in the up-and-down direction.

* * * * *